US008025295B2

(12) United States Patent
Bizilia et al.

(10) Patent No.: US 8,025,295 B2
(45) Date of Patent: Sep. 27, 2011

(54) CHRISTMAS TREE GAME

(76) Inventors: Stephen J. Bizilia, Endicott, NY (US); Lori Elizabeth McCarthy, Endicott, NY (US)

( * ) Notice: Subject to any disclaimer, the term of this patent is extended or adjusted under 35 U.S.C. 154(b) by 0 days.

(21) Appl. No.: 12/707,789

(22) Filed: Feb. 18, 2010

(65) Prior Publication Data

US 2011/0198807 A1 Aug. 18, 2011

Related U.S. Application Data

(60) Provisional application No. 61/232,521, filed on Aug. 10, 2009.

(51) Int. Cl.
*A63F 3/00* (2006.01)

(52) U.S. Cl. ..... 273/276; 273/241; 273/287

(58) Field of Classification Search ..... 273/241, 273/276, 282.3, 287, 288, 289, 290
See application file for complete search history.

(56) References Cited

U.S. PATENT DOCUMENTS

| | | | | |
|---|---|---|---|---|
| 268,577 | A * | 12/1882 | Warren | 273/241 |
| 3,701,531 | A | 10/1972 | Bowers | |
| 3,791,421 | A | 2/1974 | Barrett | |
| 3,819,457 | A | 6/1974 | Mottel | |
| 3,940,877 | A | 3/1976 | Culkin | |
| 3,959,536 | A | 5/1976 | Chase | |
| 4,043,560 | A * | 8/1977 | Blackman | 273/236 |
| 4,219,594 | A | 8/1980 | Herrera-Cabello | |
| 4,247,114 | A * | 1/1981 | Carroll | 273/274 |
| 4,375,288 | A | 3/1983 | Guertin | |
| D276,055 | S | 10/1984 | Guertin | |
| 4,543,278 | A | 9/1985 | Ackermann | |
| 4,609,576 | A | 9/1986 | Liu | |
| 4,650,422 | A | 3/1987 | Gorczynski | |
| D295,054 | S | 4/1988 | Allen | |
| 4,781,643 | A | 11/1988 | Holloway et al. | |
| D309,639 | S | 7/1990 | Knudsen | |
| 5,246,374 | A | 9/1993 | Boodram | |
| 5,306,366 | A | 4/1994 | Shattan | |
| D351,810 | S | 10/1994 | Lange et al. | |
| 5,413,825 | A | 5/1995 | Chaikin | |
| 5,422,797 | A | 6/1995 | Shattan | |
| 5,855,502 | A | 1/1999 | Truchsess | |
| 6,053,798 | A | 4/2000 | Tang | |

(Continued)

FOREIGN PATENT DOCUMENTS

EP 0269099 A2 6/1988

OTHER PUBLICATIONS

Kim, D.H. Any Time Anywhere, Play! Board Game "Tumbling Monkey Mini" I Internet News—Game Donga. Jul. 3, 2006. http://www.gamedonga.co.kr/gamenews/gamenewsview.asp?sendgamenews=17968.

(Continued)

*Primary Examiner* — Vishu K. Mendiratta
(74) *Attorney, Agent, or Firm* — Brown & Michaels, PC

(57) ABSTRACT

A game comprises: a game board; a tree trunk for each player playing the game, the tree truck attachable to the game board; a plurality of branches for the each player playing the game, the plurality of branches attachable to the tree trunk; a tree topper; and a pair of dice; wherein players in turn roll the pair of dice and build a tree from the tree trunk and the plurality of branches based on rolls of the pair of dice.

6 Claims, 3 Drawing Sheets

U.S. PATENT DOCUMENTS

| | | | |
|---|---|---|---|
| 6,062,701 | A | 5/2000 | Hines |
| 6,322,896 | B1 | 11/2001 | Docherty |
| D453,910 | S | 2/2002 | Jones, II |
| 6,343,971 | B1 | 2/2002 | Hou |
| 6,386,942 | B1 | 5/2002 | Tang |
| 6,564,490 | B1 | 5/2003 | Avila |
| 6,755,715 | B2 | 6/2004 | Wong |
| D515,627 | S | 2/2006 | Orgovany-Hanstein |
| D530,102 | S | 10/2006 | Vincent |
| 2005/0017457 | A1 | 1/2005 | Dubinsky |
| 2006/0158872 | A1 | 7/2006 | Huang |

OTHER PUBLICATIONS

International Search Report dated Dec. 3, 2010 for PCT/US2010/035374.

* cited by examiner

CHRISTMAS TREE GAME

REFERENCE TO RELATED APPLICATIONS

This application claims one or more inventions which were disclosed in Provisional Application No. 61/232,521, filed Aug. 10, 2009, entitled "Christmas Tree Game". The benefit under 35 USC §119(e) of the United States provisional application is hereby claimed, and the aforementioned application is hereby incorporated herein by reference.

BACKGROUND OF THE INVENTION

The present invention generally relates to a board game, and more specifically relates to a Christmas-themed board game that may be enjoyed by people celebrating Christmas around the world.

SUMMARY OF THE INVENTION

In one aspect of the present invention, a game comprises a game board; a tree trunk for each player playing the game, the tree truck attachable to the game board; a plurality of branches for the each player playing the game, the plurality of branches attachable to the tree trunk; a tree topper; and a pair of dice; wherein players in turn roll the pair of dice and build a tree from the tree trunk and the plurality of branches based on rolls of the pair of dice.

In another aspect of the present invention, a method for playing a game, comprises opening a game board; rolling a pair of six-sided dice within a center area of the game board; taking an action in response to the rolling of the pair of six-sided dice; and continuing to roll the dice and to take the action until a tree topper is placed atop a tree trunk.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide a Christmas tree game that combines the joy of Christmas with a fun and challenging board game.

Figure 1:
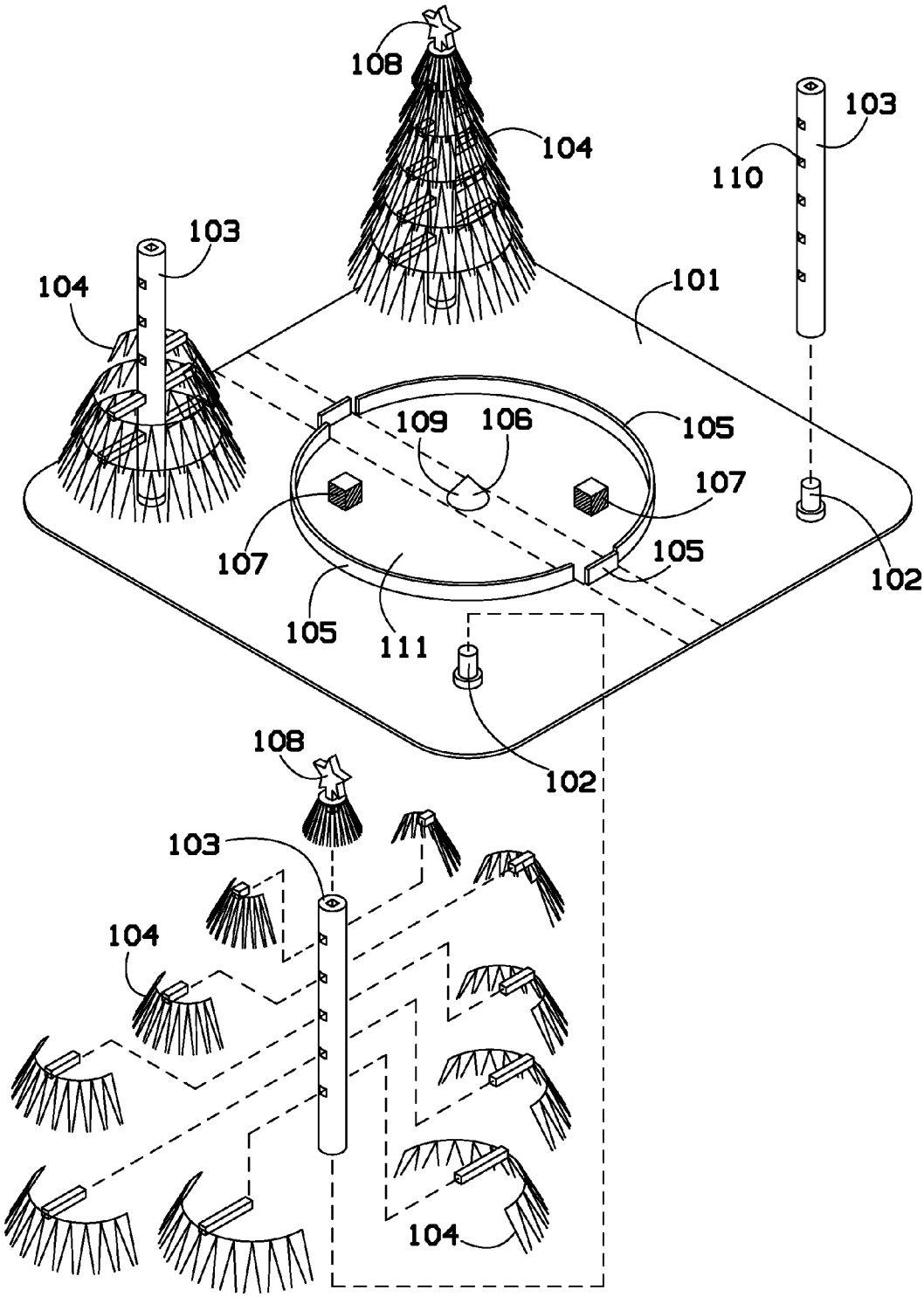
FIG. 1 shows a view of the components of a Christmas tree game in accordance with an embodiment of the present invention.
Figure 2:
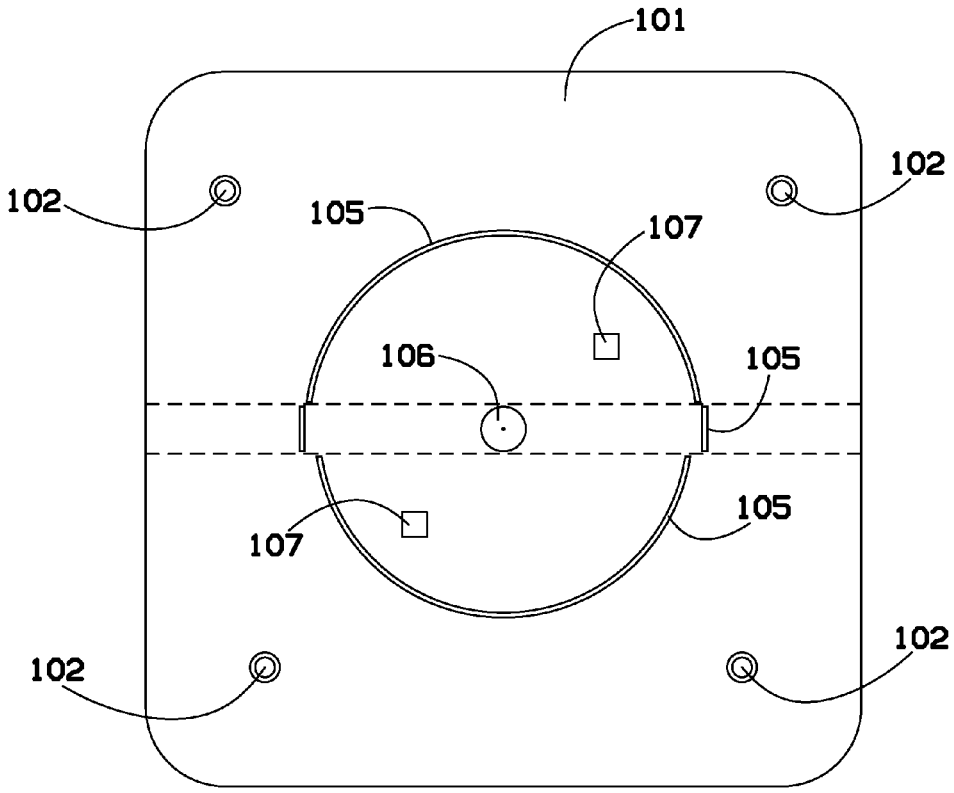
FIG. 2 shows an overhead view of the game board and dice of the Christmas tree game shown in FIG. 1.
Figure 3:
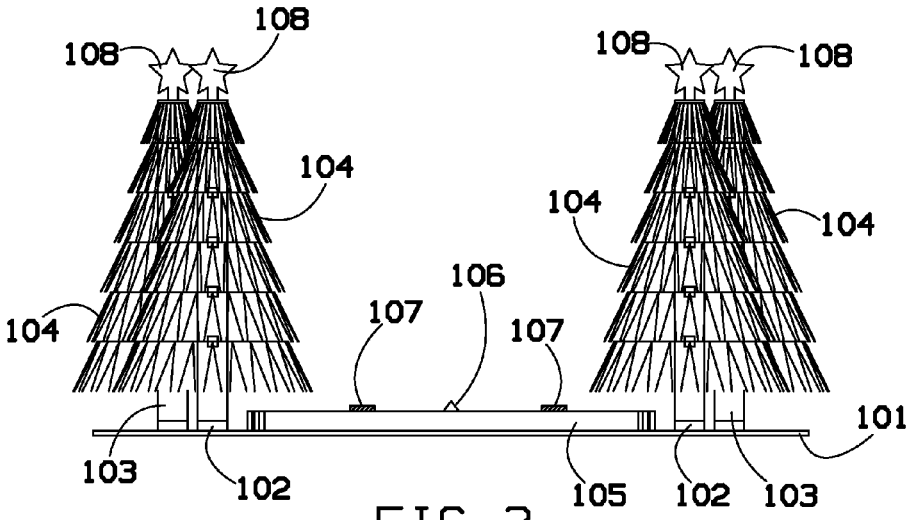
FIG. 3 shows a side view of the components of the Christmas tree game shown in FIG. 1.

FIG. 1 shows a view of the components of a Christmas tree game in accordance with an embodiment of the present invention. FIG. 2 shows an overhead view of the game board and dice of the Christmas tree game shown in FIG. 1. FIG. 3 shows a side view of the components of the Christmas tree game shown in FIG. 1.

In accordance with an embodiment of the present invention, the Christmas tree game may comprise a game board 101, Christmas tree trunks 103, branches 104, colored dice 107, and a tree topper 108, such as a star.

The game board 101 may be a foldable board on which the Christmas tree game may be played. The game board 101 may be approximately 18-inches square and may have rounded corners. The game board 101 may comprise, for example, four pre-fastened bases 102 near each corner of the game board 101 that may accept the Christmas tree trunks 103 so that the Christmas tree trunks 103 may be held straight and firmly in place on the game board 101. The bases 102 may also be situated in an offset position so that the game board 101 may fold up flat. A center area 111 of the game board 101 may comprise a cone 106 at the center point 109 of the game board 101 and a containment fence 105 that forms a circle around the center area 111 of the game board 101. The cone 106 may protrude from the game board 101 and may scatter the dice 107 when the dice 107 are dropped over the cone 106. The containment fence 105 may help keep the dice 107 contained within the center area 111 of the game board 101 when the dice 107 are dropped on and scattered by the cone 106. The containment fence 105 may also be fixed in an offset position to allow the game board 101 to fold flat.

The Christmas tree trunks 103 may be affixed to the game board 101 by inserting the Christmas tree trunks 103 into the pre-fastened bases 102 on the game board 101. The trunks 103 may be straight rods having square holes 110 up and around its body that may accept the branches 104 of the Christmas tree in order to attach the branches 104 to the Christmas tree trunk 103.

The branches 104 of the Christmas tree may be inserted into the holes 110 of the Christmas tree trunks 103 to attach to the Christmas tree trunk 103. The branches 104 may be constructed in one piece, and, as can be seen in the drawing, are of differing size such that the branches gradually reduce in length as the tree grows up to the top end for a natural appearance when the tree is constructed, with the lowest level having the longest flared-out branches and the longest square ended stems and the highest level having the shortest branches and stems. The branches may have impressions of needles and/or secondary branches pressed into the branches 104. The branches 104 may also have decorative ornaments fixed or painted on to them to create a more colorful tree.

The tree topper 108 may be placed atop the Christmas tree created by a Christmas tree trunk 103 and branches 104 of the winning player. The tree topper 108 may light up, play a Christmas tune, and/or ring a bell when it is place on top of a Christmas tree.

The colored dice 107 may comprise a pair of dice 107 having the same color pattern. Each of the colored dice 107 may be a 6-sided dice having two opposite sides that may be red and the other four sides that may be green.

In an exemplary embodiment of the present invention, one to four players may play the Christmas tree game. The game board may be unfolded flat on a flat surface with the cone and the containment fence rising from the game board. Each player may have a Christmas tree trunk and branches to complete his Christmas tree.

Figure 4:
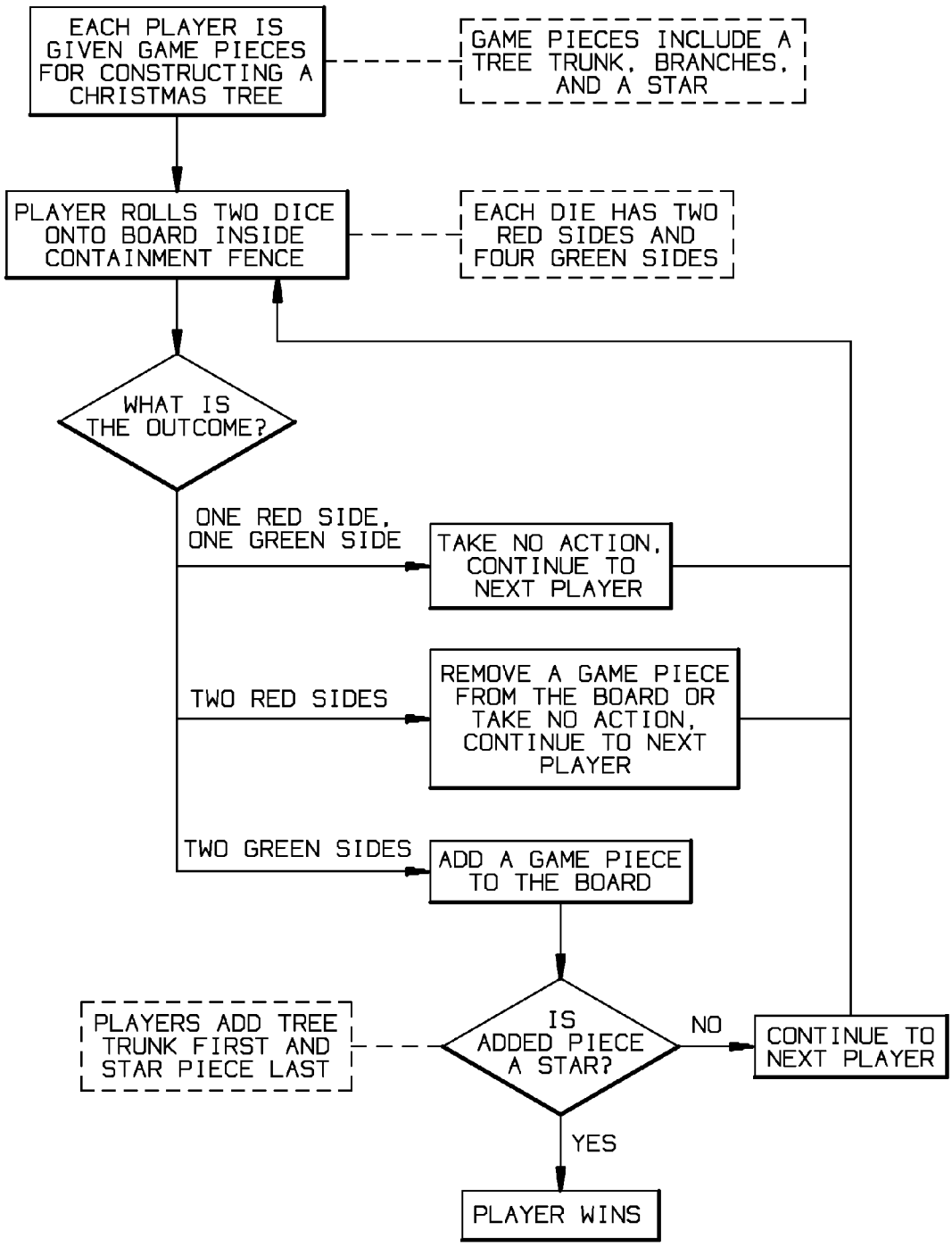
FIG. 4 shows a flowchart of a method for playing the Christmas tree game of FIG. 1.

FIG. 4 shows a flowchart of a method for playing the Christmas tree game in accordance with an embodiment of the present invention.

The object of the Christmas tree game may be to be the first player to finish constructing his Christmas tree including placing a tree topper atop the Christmas tree. To play the Christmas tree game in accordance with an embodiment of the present invention, each player of the game may be given game pieces for constructing a Christmas tree, including a tree trunk, branches, and a tree topper, and may take turns tossing the pair of dice within the area of the game board contained by the containment fence.

If the value of the pair of tossed dice is two red sides, the rules may instruct the player to remove one part of his Christmas tree. For example, the player may remove a branch from his Christmas tree trunk, remove the Christmas tree trunk from the game board if the player's Christmas tree trunk does not have any branches attached to it, or do nothing if he has not yet had the opportunity to attach his Christmas tree trunk to the game board.

If the value of the pair of tossed dice is two green sides, the rules may instruct the player to add a part to his Christmas tree. The player may attach his Christmas tree trunk to the game board via one of the pre-fastened bases on the game board if he has not yet had the opportunity to do so, attach a branch to his Christmas tree trunk if his Christmas tree trunk has already been attached to the game board and if his Christmas tree trunk is not completely full of attached branches, or place a tree topper on top of his Christmas tree if his Christmas tree trunk is completely full of attached branches, thus signifying that the player has won the game.

If the value of the pair of tossed dice is one green side and one red site, the dice may signify that the player should take no action and that his turn has ended.

The players of the Christmas tree game should take turn rolling dice and taking actions in accordance with the dice rolled, until one player wins by placing the tree topper atop his Christmas tree. After a player has placed the tree topper atop his Christmas tree, the game may be ended, or the remaining players may continue playing the game until they each are able to place a tree topper atop their respective Christmas trees.

In accordance with alternate embodiments of the present invention, the Christmas tree game may be implemented as a computer game, wherein the elements of the games and rules may be implemented using software, hardware, or a combination of software and/or software.

It should be understood, of course, that the foregoing relates to exemplary embodiments of the invention and that modifications may be made without departing from the spirit and scope of the invention as set forth in the following claims.

We claim:

1. A game comprising:

a game board having four corners, a cone jutting from a center of the board, and a folding containment fence surrounding the cone;

four tree stumps, each stump mounted near a corner of the game board;

four tree trunks attachable to the tree stumps near the corners of the game board, each tree trunk having a lower end for mounting to a tree stump, an upper end, and a length therebetween, each trunk having a plurality of square holes spaced along the length of the tree trunk;

four sets of branches, each set comprising a plurality of branches, each branch having a square stem end sized for insertion into the square holes on a tree trunk, a branch end, and a length therebetween simulating an evergreen tree branch, the lengths of the plurality of branches being graduated from a largest size for mounting at the lower end of a tree trunk to a smallest size for mounting at the upper end of a tree trunk; and four tree toppers, one for each tree trunk, attachable to the upper end of the tree trunk;

such that when a tree trunk is mounted to a tree stump, and the plurality of branches in a set are mounted to the tree trunk by insertion of the square stem ends of the branches into the square holes along the length of the tree trunk, and the tree topper is attached to the upper end of the tree trunk, the tree stump, tree trunk, the tree topper and the plurality of branches simulate a Christmas tree.

2. The game of claim 1, further comprising a pair of six-sided dice, each of the pair of dice having two opposed sides with a first color and four sides with a second color.

3. The game of claim 2, wherein the first color comprises a red color and the second comprises a green color.

4. A method for playing a game comprising a game board having four corners and a cone jutting from a center of the board; four tree stumps, one for each player, each stump mounted near a corner of the game board; four tree trunks attachable to the tree stumps near the corners of the game board, each tree trunk having a lower end for mounting to a tree stump, an upper end, and a length therebetween, each trunk having a plurality of square holes spaced along the length of the tree trunk; four sets of branches, each set comprising a plurality of branches, each branch having a square stem end sized for insertion into the square holes on a tree trunk, a branch end, and a length therebetween simulating an evergreen tree branch, the lengths of the plurality of branches being graduated from a largest size for mounting at the lower end of a tree trunk to a smallest size for mounting at the upper end of a tree trunk; four tree toppers, one for each tree trunk, attachable to the upper end of the tree trunk; and a pair of six-sided dice, each of the dice having two opposed red sides and four green sides; the method comprising:

a) a player picking up the pair of six-sided dice;

b) the player dropping the pair of six-sided dice on the cone in the center area of the game board;

c) the player taking an action in response to the rolling of the pair of six-sided dice; the action comprising:

i) if the pair of six-sided dice show two green sides, adding a part to a tree to build a Christmas tree, the step of adding a part comprising:

A) attaching a tree trunk to a tree stump if a tree trunk is not yet attached to the tree stump; or B) attaching a branch to the tree trunk by inserting the square stem end of the branch into a square hole on the trunk, if the tree trunk is attached to the stump and the tree trunk is not full of attached branches; or C) placing a tree topper on the upper end of the tree trunk if the tree trunk is completely full of attached branches, completing the Christmas tree and declaring the player as a winner;

ii) if the pair of six-sided dice show two red sides, removing a part from the tree; and d) a next player picking up the dice and repeating the method from the dropping step (b).

5. The method of claim 4, wherein when a player places a tree topper on the upper end of the tree trunk, play is ended and the player who placed the tree topper wins the game.

6. The method of claim 4, wherein when a player places a tree topper on the upper end of the tree trunk, the player is declared a winner, and play continues until all players have placed a tree topper on the upper end of a tree trunk.

* * * * *